United States Patent [19]

Harrington et al.

[11] Patent Number: 5,041,207

[45] Date of Patent: Aug. 20, 1991

[54] OXYGEN ADDITION TO A COKING ZONE AND SLUDGE ADDITION WITH OXYGEN ADDITION

[75] Inventors: Joseph A. Harrington; Ciro D. Sorrentino, both of Naperville; Dean G. Venardos, Batavia; Shri K. Goyal, Naperville, all of Ill.; Irwin Ginsburgh, Newhall, Calif.

[73] Assignee: Amoco Corporation, Chicago, Ill.

[21] Appl. No.: 285,110

[22] Filed: Dec. 15, 1988

Related U.S. Application Data

[63] Continuation-in-part of Ser. No. 937,990, Dec. 4, 1986, abandoned.

[51] Int. Cl.[5] ..... C10G 9/14; C10G 17/00

[52] U.S. Cl. ..... 208/131; 201/25; 208/48 R

[58] Field of Search ..... 208/48 R, 50, 131, 127; 201/2.5, 25, 36

[56] References Cited

U.S. PATENT DOCUMENTS

| | | | |
|---|---|---|---|
| 1,470,359 | 10/1923 | Greenstreet | 208/48 R |
| 2,347,805 | 5/1944 | Bell | 196/65 |
| 3,017,564 | 11/1975 | Meyers | 208/131 |
| 3,702,816 | 11/1972 | Buchmann et al. | 208/50 |
| 3,960,704 | 6/1976 | Kegler et al. | 208/50 |
| 4,051,014 | 9/1977 | Masologites | 208/131 X |
| 4,176,045 | 11/1979 | Leftin et al. | 208/48 R |
| 4,332,671 | 6/1982 | Boyer | 208/131 |
| 4,404,092 | 9/1983 | Auden et al. | 208/131 |
| 4,534,851 | 8/1985 | Allan et al. | 208/48 R |
| 4,874,505 | 10/1989 | Bartilucci et al. | 208/131 |

FOREIGN PATENT DOCUMENTS

| | | |
|---|---|---|
| 204410 | 12/1986 | European Pat. Off. . |
| 3726206 | 3/1988 | Fed. Rep. of Germany . |

*Primary Examiner*—Curtis R. Davis

*Attorney, Agent, or Firm*—Robert E. Sloat; William H. Magidson; Ralph C. Medhurst

[57] ABSTRACT

A process is disclosed wherein at least two separate gaseous oxygen streams are passed into a coker transfer line to effect oxidation of a portion of the feed passing through the transfer line. Another aspect of the process is disclosed wherein gaseous oxygen is passed into a coking process and sludge is also passed into the coking process.

36 Claims, 5 Drawing Sheets

OXYGEN ADDITION TO A COKING ZONE AND SLUDGE ADDITION WITH OXYGEN ADDITION

CROSS-REFERENCE TO RELATED APPLICATIONS

This application is a continuation-in-part application based on copending application U.S.S.N. 937,990, filed Dec. 4, 1986, abandoned all the contents of which are incorporated into this application by specific reference thereto.

This application is also copending with application U.S. Ser. No. 285,111 filed concurrently herewith.

BACKGROUND OF THE INVENTION

1. Field of the Invention

The field of art to which this invention pertains is hydrocarbon coking operations in which one or more gaseous streams comprising oxygen is added to the coker transfer line which carries feedstock to the coker, and an improvement involving adding one or more gaseous streams comprising oxygen to a coker into which sludge is also being added.

2. General Background

Coking operations in most modern refineries produce solid coke, and vapor products from heavy residual oil feedstocks which are fed to the coking process. The coking process can be either a delayed coking operation or a fluidized coking operation.

In fluid coking, a feedstock contacts a fluidized bed of coke particles maintained at a sufficiently high temperature to effect conversion of the feed into solid coke particles and lighter liquid and vapor materials which are recovered from the fluidized bed. Part of the solid coke formed in this operation is passed into a separate gasifier vessel where it is burned to produce additional heat. This heat is recycled back into the fluid bed of coke particles in the reaction section through higher temperature coke particles which provide heat to help maintain process operations.

In the more usual application of the coking process, a delayed coking drum is used. A heavy residual oil is heated in a furnace, passed through a transfer line and then into the coking drum. In the coking drum, which is typically an elongated vessel, the residual feedstock is thermally decomposed to a heavy tar or pitch material which further decomposes with time into solid coke and vapor materials. The vapor materials formed during the coking reaction are recovered from the delayed coking drum and a solid coke material is left behind.

The vapor products are removed from the top of the coke drum through a coke drum vapor outlet and passed through an elongated coke drum overhead line which is connected to a fractionator, often called a combination tower. In the combination tower, gaseous and liquid products are recovered for further use in the refinery.

After a period of time the feed to the coke drum is stopped and routed to another drum and the coke laden drum is then purged of vapors, cooled and opened so that the solid coke inside the drum can be removed.

In operating a coking process, the refiner generally aims to minimize coke production and maximize liquid products, since the liquid is more easily converted into gasoline or other materials having higher values than the solid coke material.

The delayed coking furnace outlet temperature is controlled between from about 870° to 950° F. Higher temperatures reduce the solid coke yield and increase the more valuable liquid product yield but may cause rapid coking in the furnace tubes and shortened on-stream time for the process. Lower transfer line temperatures produce soft coke, higher coke yield, and lower liquid yield but permit long on-stream time for the process.

The coke formation reactions are essentially endothermic with the temperature dropping to 780° to 900° F., more usually to 810° to 880° F. in the coke drum. Coke drum pressures are maintained in the range generally from about 10 to 70 psig.

The transfer line connects the coker furnace to the coke drum, and the temperature of the coker feedstock passing through the transfer line is typically called the transfer line temperature. Raising the temperature of the transfer line increases yields of valuable liquid products while reducing the yield of solid coke. Since a primary object of delayed coking processes in refinery environments is to maximize the production of valuable liquid products from the residual feeds, maximizing the liquid yield while minimizing the solid coke yields is desirable.

To maximize the transfer line temperatures, various methods have been used to increase the coker feed temperatures while reducing or minimizing any adverse effects accompanying these higher temperatures. Adding hot coke particles to the delayed coker feed has been disclosed. Adding oxygen-containing solids to increase transfer line temperature through oxidation of the feed passed into the coking drum is known. Additional methods for increasing transfer line temperatures include combustion of part of the feed or coke produced in the delayed coker in a separate combuster which is heat exchanged with the coker feed.

U.S. Pat. No. 2,412,879 discloses a process in which a cellulosic material such as sawdust is added to delayed coker feed to reduce the amount of solid coke produced from the feedstock and to produce an easily crushable and porous solid coke material. The cellulosic material is converted at least partially to charcoal indicating that some oxidation of the sawdust material occurs before entry of the sawdust-feed mixture into the delayed coking drum.

U.S. Pat. No. 4,096,097 similarly teaches a process of producing high quality coke in a delayed coking process by adding an effective amount of an oxygen-containing carbonaceous material which decomposes at the high temperatures of the feed passing into the delayed coking drum. As disclosed in this patent, the oxygen content of the carbonaceous additive should be within the range from about 5 to 50 weight percent and usually no higher than 60 weight percent of the oxygen-containing material added to the feed. The carbonaceous materials which are taught to be effective include coal, lignite, and other materials such as sugar beet waste, sawdust, and other cellulosic wastes. It is speculated in this patent that the decomposition of the oxygen-containing molecules at the coking temperatures in the coking drum effect the release of heat. Water is also produced which promotes increased liquid yields and a more porous structure of the solid coke material.

U.S. Pat. No. 4,302,324 also relates to an improved delayed coking process in which hot coke particles are added to the heated coker feedstock to raise its temperature by at least 50° F. The coke produced in this process is lower in volatiles and has improved mechanical strength, and the yield of liquid product is increased.

Another process involves coking hydrocarbon oils by contacting a feed with free oxygen in the presence of an aqueous liquid which is maintained at least partially in the liquid phase to produce high quality coke and increase yields of liquid products from the coking reaction. This process is exemplified in U.S. Pat. Nos. 4,370,223 and 4,428,828. Sometimes the entire heat requirements for the process can be provided by the oxidation of the heavy hydrocarbon feed in the aqueous system with free oxygen.

Another process in which oxygen reacts with a residual feed is asphalt blowing. This process is exemplified in U.S. Pat. No. 3,960,704 in which isotropic petroleum coke is produced from a residual feedstock by blowing the feedstock with air until it has a softening temperature between from about 49° to 116° C. and subjecting the blown residuum to a delayed coking process.

The fluid bed coking art is replete with patents in which air or oxygen is added to a fluidized coking process to enhance fluid coke properties and decrease the need for external heat addition to the process. In particular, U.S. Pat. Nos. 2,537,153, 3,264,210, 3,347,781, 3,443,908, and 3,522,170 discuss various methods for using oxygen either directly injected into a fluid bed of coke or combusting a part of the fluid coke with the oxygen to supply additional heat to the fluid bed process.

One of the advantages associated with oxygen addition to the coker transfer line, as claimed by Applicants, is a decrease in the amount of coke produced with an increase in the liquid product produced in the delayed coking zone because the feed to the coking drum is at sufficiently high temperature to encourage these results. The additional heat generated by partial feedstock combustion in the transfer line results in increased temperatures in the transfer line rather than in the furnace. This reduces the risk of coking in the furnace tubes resulting in a higher operating factor for the delayed coker furnace Since the oxygen addition is to a feed having a temperature above about 800° F., it is important that oxygen addition be regulated by careful positioning of the oxygen addition stream or streams. At temperatures above 800° F. oxidation of the feed can occur very rapidly and if the oxygen-containing stream is not properly controlled, high temperature excursions can result.

Sludge production from a typical refinery or petrochemical plant can come from many sources including API separator bottoms, slop oil, emulsions, storage tank bottoms, sludge from heat exchangers, oily waste, MEA reclaimer sludges, and other waste materials produced in the refinery. The typical sludge will contain solids, which may be organic, inorganic or combinations of both, oil, liquid and aqueous materials.

In most refinery or petrochemical operations the sludge is often sent to a separator zone for gross removal of water and hydrocarbons after which the water and concentrated hydrocarbons and solids can be individually treated by landfarming or further biological or other known waste treatment means.

In U.S. Pat. No. 4,552,649 (U.S. Class 208/127), an improved fluid coking process is described where an aqueous sludge which comprises organic waste material is added to a quench elutriator to cool the coke in the elutriator and convert at least a portion of the organic waste to vaporous compounds which can be recycled to the fluid coking heating zone to increase the temperature of the fluid coke particles therein.

In the delayed coking process, sludges have been disposed of in various manners.

In U.S. Pat. No. 3,917,564 (U.S. Class 208/131) sludges or other organic by-products are added to a delayed coking drum during a water quenching step after feed to the coke drum has been stopped and the coke drum has been steamed to remove hydrocarbon vapors. The quenching step cools the hot coke within the coke drum to a temperature that allows the coke to be safely removed from the coking drum when it is opened to the atmosphere.

The sludge is added along with the quench water and contacts the solid coke in the coke drum at conditions which allow the vaporization of the water contained in the sludge. The organic and solid component of the sludge is left behind through deposition on the coke and removed from the coke drum as part of the solid coke product.

U.S. Pat. No. 4,666,585 (U.S. Class 208/131) relates to the disposal of sludge in a delayed coking process by adding sludge to the coker feedstock and subjecting the feedstock and sludge mixture to delayed coking conditions.

U.S. Pat. No. 2,043,646 (U.S. Class 202/16) discloses a process for the conversion of acid sludge into sulfur dioxide, hydrocarbons and coke in a two-step procedure comprising passing sludge into a kiln to produce semi-coke and then passing the semi-coke into a coke drum for conversion into coke product.

U.S. Pat. No. 1,973,913 (U.S. Class 202/37), coke which has been removed from a coking oven or coking drum is quenched with polluted wastewater which contains tar acids. After quenching the tar acids remain on the coke and the aqueous materials associated with these acids is vaporized.

U.S. Pat. No. 4,404,092 (U.S. Class 208/131) discloses a process for increasing the liquid yield of a delayed coking process by controlling the temperature of the vaporous space above the mass of coke in the coke drum by injecting a quenching liquid into the vapor phase within the delayed coking drum. The patent teaches that large amounts of liquid should be added to the vapor space within a delayed coking drum (about 9 percent by weight of the feed).

U.S. Pat. No. 2,093,588 (U.S. Class 196/61) discloses a process for delayed coking in which liquid materials such as hydrocarbons or water are passed into the vapor portion of a delayed coking zone. This patent teaches a process very similar if not identical to that disclosed in U.S. Pat. No. 4,404,092 described above.

Copending application U.S.S.N. 285,111 (Docket No. 26,878) filed concurrently with this application, claims a process for adding sludge to a coking zone. The heat requirements for evaporating the sludge and converting it to non-toxic material can be supplemented by the heat generated through gaseous oxygen addition as described in the present application.

Another aspect of the present invention is to combine oxygen addition to a coking zone as described in the present application with sludge addition to the coking zone as described in the above copending application to provide an improved sludge addition process.

When oxygen is added to a coking zone to which sludge is being added, it is preferable to add the oxygen to the transfer line where it can mix with hot feed. However, in such cases the oxygen could be added to the coking zone at other locations such as in the coke drum or along with the sludge.

Sludge addition may take place at any convenient location in the coke drum. The preferred locations, however, are in the feed or in the vapor section of the coke drum. In the latter case, sludge is generally added as a separate stream, at conditions to effect contact of the sludge with the vapor products within the coke drum and vaporization of at least a portion of the sludge while oxygen is preferably added to the transfer line. In a preferred instance, all of the aqueous portion of the sludge is vaporized and some of the hydrocarbon in the sludge is converted to coke while oxygen is added to the transfer line.

The improved sludge addition process also can eliminate a major concern of having to dispose of potentially hazardous materials by breaking them down into relatively harmless materials which themselves can be further converted into useful refinery products such as gasoline or other refinery products. This also eliminates the need for land farms or other waste disposal methods which can add considerable expense to refinery operations.

SUMMARY OF THE INVENTION

An invention disclosed herein can be summarized as an improved coking process in which oxygen is added through multiple injection streams to the transfer line which connects the feed furnace and the delayed coking drum. Conditions in the transfer line are controlled to effect oxidation of at least a portion of the feed in the transfer line and, preferably, substantially complete consumption of the added oxygen in the transfer line.

Another invention disclosed herein can be summarized as an improvement to a coking process in which sludge is added to the coking zone at conditions to effect thermal conversion of at least a portion of the sludge wherein oxygen is added to the coking zone at conditions to effect oxidation of a portion of the feedstock.

It is an object of the present invention to provide an improved delayed coking process in which the operating temperature in the coke drum can be increased without reducing the operating factor for the feed furnace to the delayed coker. It is another object of a present invention to provide increased liquid yields and decreased solid coke yields through the use of oxygen addition to the transfer line. Another object of the present invention is to provide improved solid coke properties by oxygen addition to the transfer line.

It is another object of the present invention to add oxygen to a coking zone to which sludge containing water and organics is also being added to recover useful and valuable products from the sludge.

It is another object of the present invention to supplement the additional heat requirements resulting from sludge addition to the coking zone by adding oxygen to the coking zone at oxidation conditions. The additional heat generated by the oxygen addition helps vaporize or convert sludge to more valuable and less toxic materials.

It is an additional object of the present invention to add oxygen to a coking zone transfer line to maintain temperatures within the zone while increasing the yield of valuable products where sludge also is being added to the coking zone.

It is an additional object of the present invention to meet the above objectives without reducing liquid yields of the hydrocarbon feedstocks passed into the coking zone, and additionally, without overloading of downstream processing equipment with large volumes of aqueous vapors which need to be condensed.

It is still an additional object of the present invention to perform the above objects without substantially reducing the partial pressure of hydrocarbons within the vapor phase within the coking zone.

The present invention of adding oxygen to the transfer line in a delayed coking zone overcomes one of the main problems associated with current commercially operated delayed coking processes. Even though delayed coker drums are well insulated, the coke drum temperature is usually 60° to 120° F. lower than the temperature in the transfer line connecting the coke drum and the feed furnace since the coking reactions occurring in the coke drum are endothermic. Higher transfer line temperatures increased the profitability of the delayed coker operation by reducing the solid coke yield. Additionally, to produce an acceptable grade anode coke from residual feedstocks, higher transfer line temperatures are also required to meet anode coke density specifications.

The common practice in the industry to increase the transfer line temperatures is to increase feed furnace temperature. However, the higher furnace tube temperatures which result are also accompanied by increased feed furnace tube fouling rates and the need for frequent decoking of the furnace tubes.

It is, therefore, desirable to increase the coke drum temperature without raising the furnace temperatures. Accordingly, an invention claimed herein meets a commercial need by increasing the transfer line temperature by adding oxygen to the transfer line through multiple injection points thereby causing oxidation of a portion of the feed passing through the transfer line. The oxidation reaction is exothermic and raises the temperature in the transfer line without increasing the feed furnace temperature which would be accompanied by increased furnace fouling rates.

Injection of sludge into the coking process, whether it be a delayed coking coke drum or a fluid bed coker, allows the sludge to contact vapor or solid coke materials in the coke drum at high process temperatures which can effect the conversion of hydrocarbons in the sludge to coke or vapor. In most cases, the toxic materials in the sludge can be converted to more environmentally acceptable materials at the high temperatures which are prevalent in a delayed coking drum. Also, addition of oxygen to the transfer line or to the coking zone at another location can help maintain temperatures in the coking zone by oxidizing feed or other hydrocarbon materials in the transfer line or coking zone. The additional heat requirements resulting from vaporization and thermally converting at least a portion of the sludge to vapor and solid materials are met by controlled oxidation which results from oxygen addition to the coking zone or transfer line.

In some of the alternative processes described in the General Background above, adding sludge to a coking zone results in certain disadvantages.

In cases where sludge is added to the coke drum during the coke quenching or cooling cycle, the temperature of the solid coke, which the sludge contacts, may not be high enough to thermally convert the sludge to coke and hydrocarbon vapors. While vaporization of the water and some liquid hydrocarbons contained in the sludge by the hot coke might occur, there may not be sufficient conversion or vaporization of the hydrocarbon component of the sludge. If the sludge contains toxic substances, they might not be converted to more acceptable and safer components.

One of the other prior art processes entails the injection of sludge into the combination tower or directly into the coker hydrocarbon feed line. If the sludge is added to the combination tower or to the coker feed materials passing through the coke heater furnace or transfer line, there is a potential for fouling of the furnace tubes or transfer lines because the sludge contains solids and highly cokable hydrocarbon materials. Additionally, in such instances, it is advisable to remove substantially all of the water from the sludge prior to injection into a high temperature liquid hydrocarbon environment and consequently additional processing equipment for this dewatering step is required.

A third alternative is injection of sludge into the coker blow down system. In such a process, sludge is injected into the upper portion of the oil scrubber and contacted with hot coke drum vapors during coke drum blow down which can last a few hours a day. Water and light oils are vaporized and go overhead. Solids and heavy oil go out the bottom, and the heavy slop is fed to the coker combination tower eventually passing through the coker feed furnace and transfer line and into the coke drum. This particular processing sequence also requires dewatering of the sludge to reduce water loads in the oil scrubber and also presents a potential fouling problem in the furnace tubes or coker transfer lines.

BRIEF DESCRIPTION OF THE DRAWINGS

FIG. 1 shows an overall process flow scheme for a commercial delayed coking process incorporating an aspect of the present invention.

Figure 1:
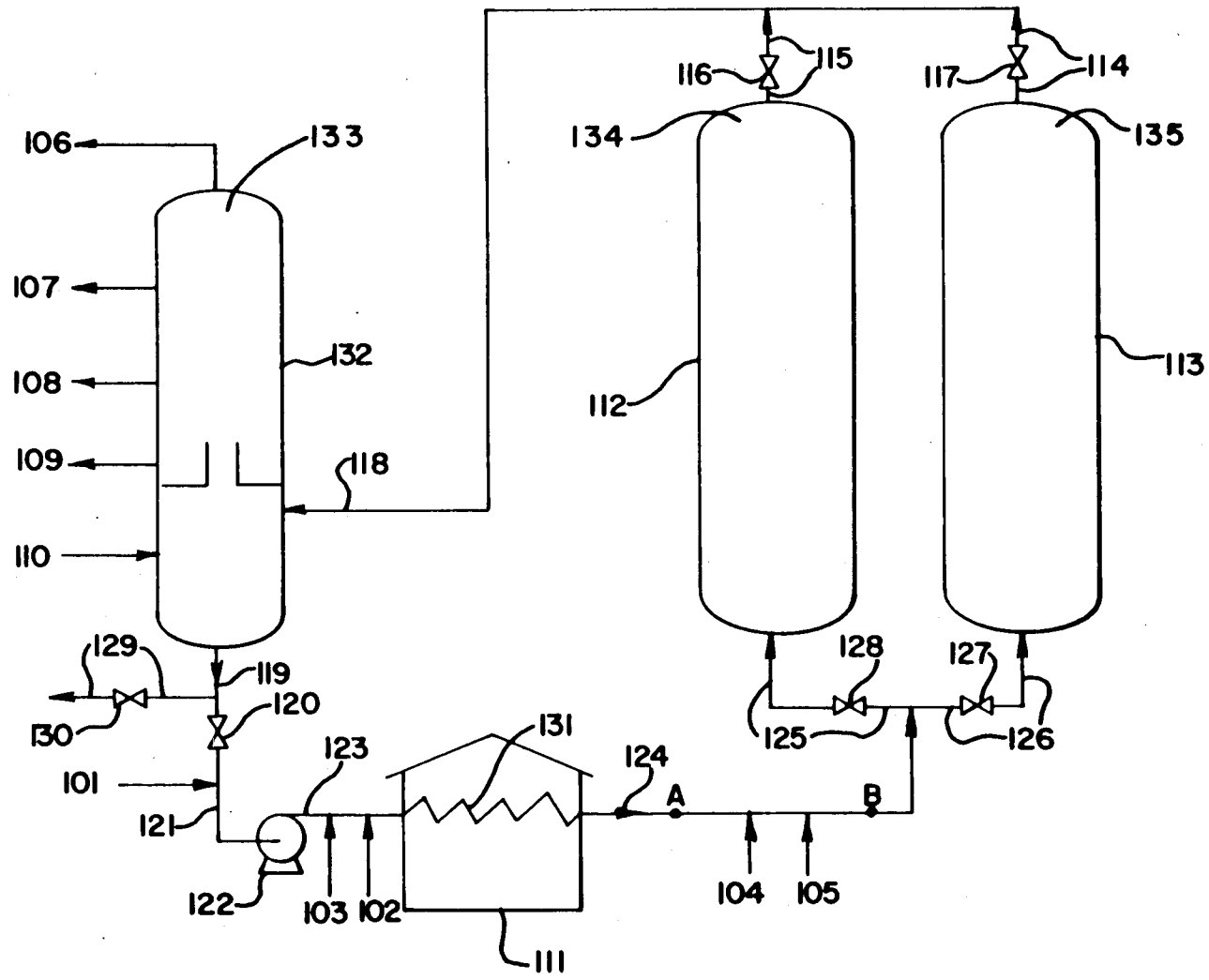
FIGS. 1 through 7 illustrate various aspects of an invention described herein.

Fresh feed which is typically a residual material passes through line 101 into line 121 which is connected to the suction side of pump 122. The discharge from pump 122 goes through line 123 into furnace 111 which contains one or more sets of coils or loops 131 which are in contact with a heating means within the furnace. The furnace can be gas or oil fired, and the combustion of these materials transfers heat to the residual feed passing through coils 131. The heated residual feed then leaves the furnace by a line 124 which represents the transfer line connecting furnace 111 to delayed coking drums 112 and 113.

In some instances, recycle distillate or other hydrocarbon materials can be passed through line 102 and mixed with the feed in line 123 before heating in the furnace. Steam can be passed through line 103 into line 123.

During normal operations the transfer line is connected to a header system, lines 125 and 126, which contains valves 128 and 127, respectively, to allow only one of the delayed coking drums to be fed heated residual feed material while the other drum is isolated for removal of solid coke. Most commercial delayed coking processes use two or more coking drums to obtain a reasonably continuous operation. One coking drum is unloaded while feed is passed to the other drum where the coking reaction takes place. Transfer line 124, therefore, can include manifold line 125 or line 126 depending on which coking drum is being fed heated feedstock.

For the purposes of the present invention points A and B on line 124 represent the transfer line although the transfer line can include any or all of the pipes and manifold volume between the exit from the residual feed furnace 111 and the entrance to the coking drums 112 or 113.

Lines 104 and 105 represent multiple injection points in transfer line 124 through which oxygen is added to the transfer line to effect oxidation of a portion of the residual feed which passes through the transfer line at conditions wherein combustion of said oxygen occurs in the transfer line to heat the feed passing through the transfer line.

Coking drums 112 and 113 are typically long vessels having been designed to allow a bed of coke to build up in the drums. The material which exits coke drums 112 and 113 and lines 115 and 114, respectively, passes into line 118 which is connected with combination tower 132.

Combination tower 132 is typically a fractionation column in which the vapor and liquids which exit the respective coking drums can be fractionated into various products utilizable within a refinery. Typically, wet gas which contains light hydrocarbons, steam and products of combustion from oxidation via oxygen addition will leave the combination tower by a line 106. This material can be treated to remove sulfur compounds and any products of combustion produced in the transfer line, such as carbon monoxide or carbon dioxide, and reused in the refinery. Naphtha, the next highest boiling point material, will leave the combination tower by a line 107. Through line 108 distillate material leaves tower 132. Gas oil will be removed from the combination tower by a line 109.

In operations in which there is recycle of some of the coker drum liquid product, a residual material generally will be passed into the combination tower through line 110. Heavy materials which leave the bottom of the combination tower through line 119 pass into line 121 returning to the delayed coking process flow loop.

In operations characterized as "once-through," line 110 is blocked off and valve 120 is also closed. The residual feed which is passed into the delayed coking process then will enter the suction side of pump 122 through line 101 and go into line 121 for eventual passage through the furnace, transfer line, coking drums and into combination tower 132. In once-through operations, a gas oil will still be removed from the combination tower by a line 109, but since valve 120 is closed and the residual feed to furnace 111 passes through lines 101 and 121, a heavy gas oil stream will generally be removed as the bottom cut from the combination tower through lines 119 and 129.

At the top of fractionation tower 132 is space 133 which normally contains only vapors or gases. Spaces 134 and 135 at the top of the coking drums also generally contain only vapors or gases. With the possibility of oxygen or carbon monoxide being present in locations 133, 134, and 135, oxygen, carbon monoxide and carbon dioxide detectors will generally be installed at these locations.

Figure 2A:
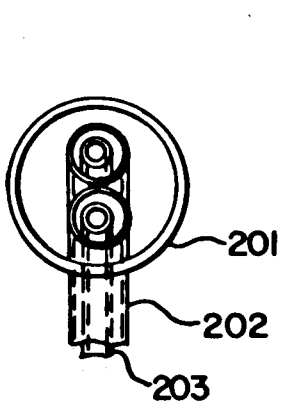
FIGS. 2A, 3A, 4A and 5A show cross sections of FIGS. 2–5 respectively.
Figure 2:
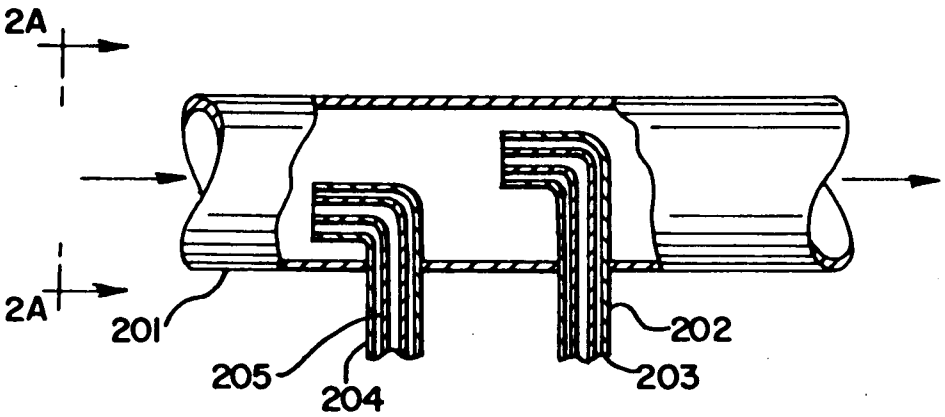

FIG. 2 shows another embodiment of the present invention. Line 201 represents the transfer line which contains multiple injection points represented by conduits 202 and 204 which enter line 201 at various points longitudinally along the transfer line. Feed material passing through the transfer line passes as indicated from left to right. Specifically, conduits 202 and 204 contain concentric conduits 203 and 205 respectively. In one embodiment, an oxygen-containing gas can pass through lines 203 and 205 into transfer line 201 while an inert gas passes through the annulus located within conduits 202 and 204. In some cases, the inert gas and oxygen-containing streams can be reversed. In a specific instance these conduits are connected to appropriate valving or other regulatory means which allows the oxygen and the inert gas flow rates to be regulated and also allows the oxygen flow rate to be stopped if an emergency should develop.

In another instance, relatively pure oxygen and a combustible gaseous stream can be passed through concentric conduits 202 and 203, respectively and also through 204 and 205 and combined within transfer line 201 to increase the temperature of the feed passing through the transfer line.

In additional embodiments, three or more separate injection points can be located at different points longitudinally along the transfer line. In almost all cases it is preferable to locate each injection point at some distance upstream or downstream from the most adjacent injection point to allow complete combustion of the gas passing into the feed passing through the transfer line before additional oxygen is added to the transfer line. The injection points should preferably be spaced at least the equivalent of three conduit diameters for even distribution of the oxygen containing gas passing into the transfer line. Uneven distribution of the combustion gas can result in hot spots in the transfer line and possible passage of unreacted oxygen gas into the coke drum.

When the transfer line is generally horizontal where the multiple injection points enter the transfer line, it is preferable to not locate the injection points at the top of the transfer line. This helps prevent formation of gas pockets at the top of the transfer line unless there is sufficient turbulence in the transfer line to cause good mixing of gas and liquid phases. In a preferred instance, as shown in FIG. 2, conduits 202 and 204 discharge gas into the transfer line countercurrent to the flow of the feed material through the transfer line. This helps mix the oxygen containing gas and the feed passing through the transfer to assist in better combustion or oxidation of feed.

Conduits 202 and 204 can contain nozzles or other means to cause the gases flowing into the transfer line to be thoroughly mixed with each other and with the liquid feed passing through the transfer line. The injection points shown in the other figures can also be similarly constructed.

Figure 3A:
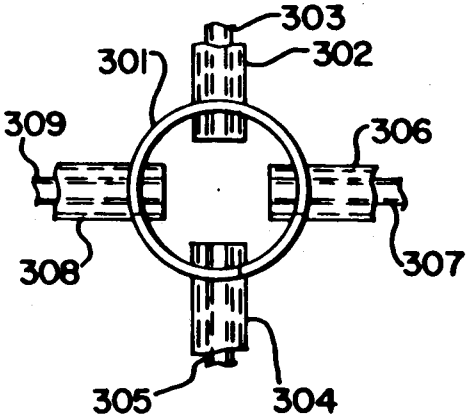
Figure 3:
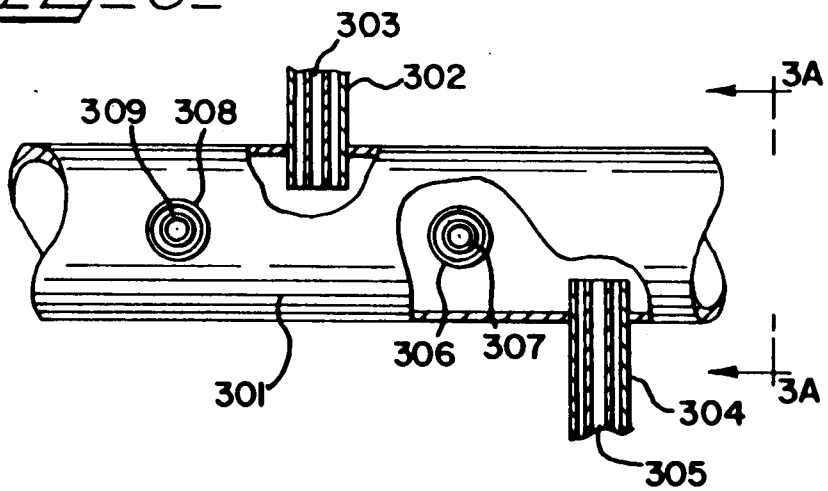
Figure 4A:
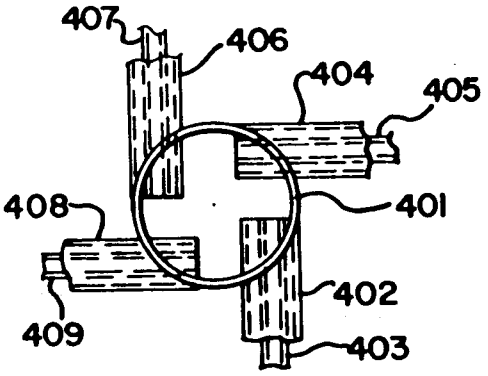
Figure 4:
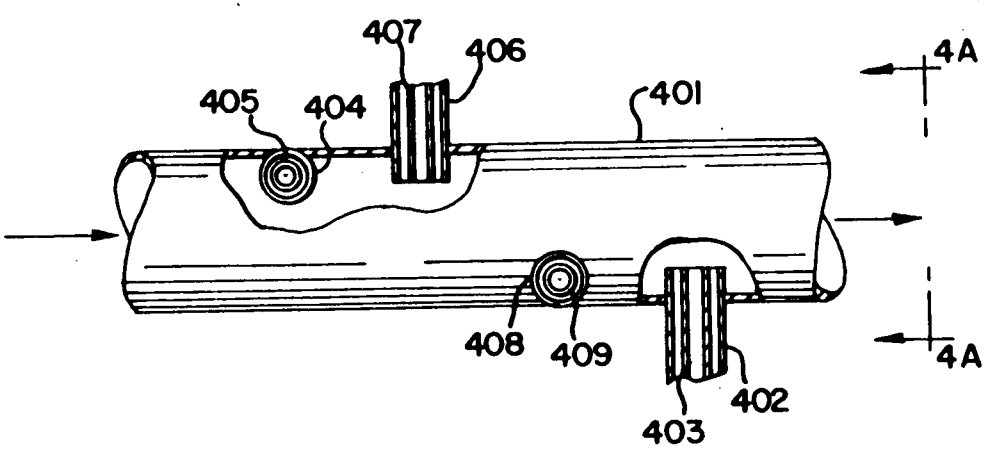

FIG. 3 shows another embodiment of the present invention in which the multiple injection points are radially spaced about the longitudinal axis of transfer line 301 and also spaced along it longitudinally. Conduits 302, 304, 306, and 308 contain concentric conduits similar to those described for FIG. 2. Radial and axial distribution of the injection points along ,transfer line 301 will help in mixing the oxygen-containing gas with the residual feedstream passing through transfer line conduit 301. Sometimes the multiple injection points which enter the transfer line 401 tangentially can be radially and longitudinally spaced on transfer line 401 as shown in FIG. 4.

Figure 5A:
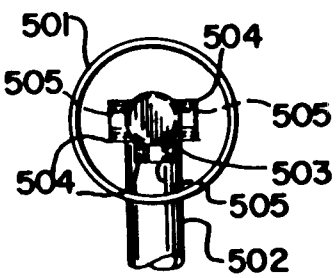
Figure 5:
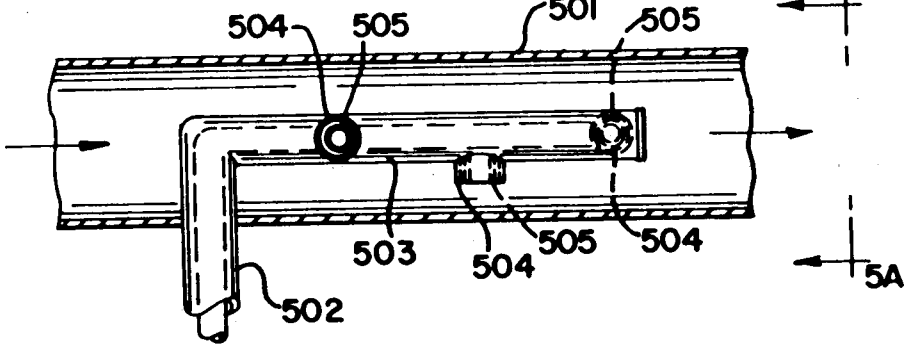

FIG. 5 shows another embodiment of the invention in which multiple injection points 504 containing concentric conduits 505 are connected to manifold 503 and pipes 500 and 502 located inside transfer line 501. These injection points are spaced along the transfer line and radially positioned. The internal design of manifold 503 provides means for passing inert gas and oxygen with respect to a delayed coking operation.

Figure 6:
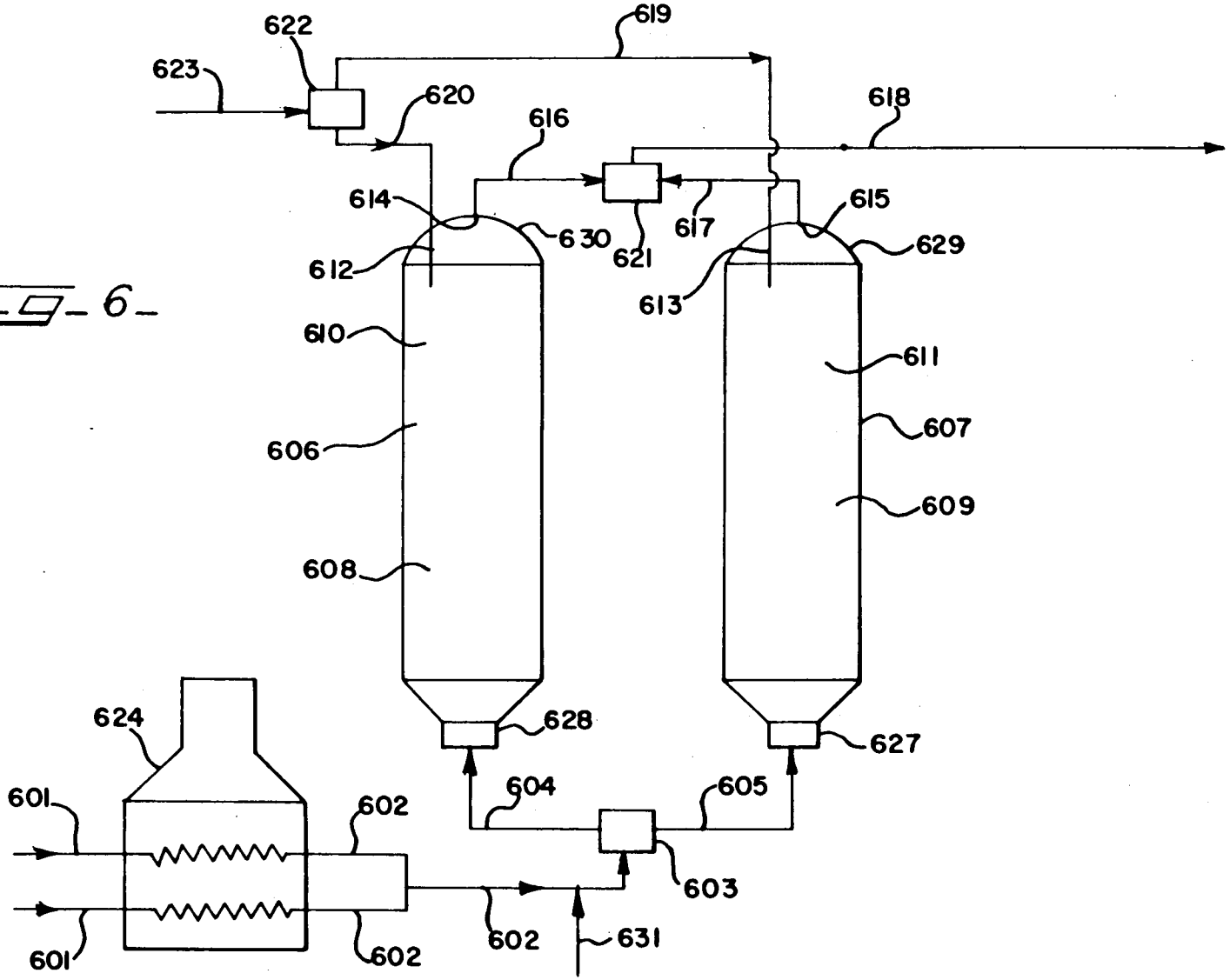
Figure 7:
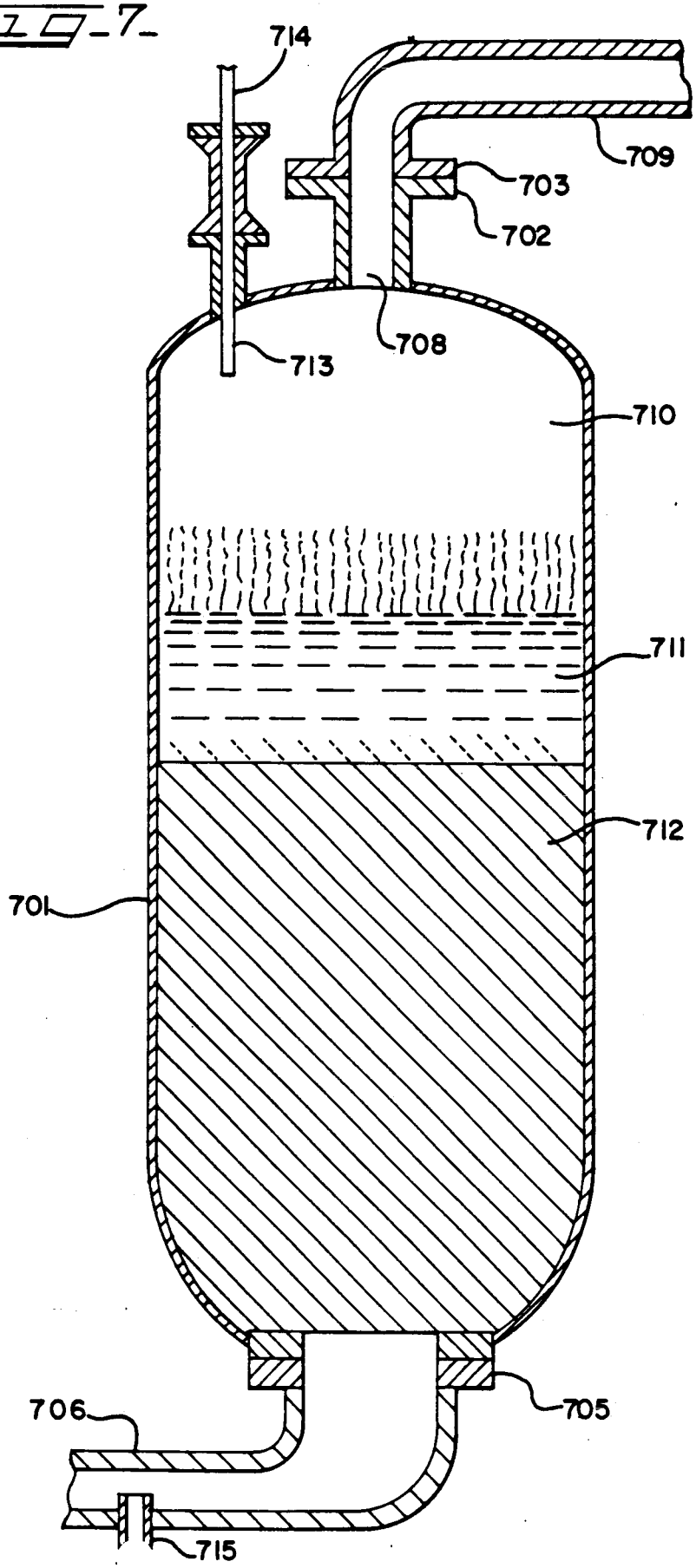

FIGS. 6 and 7 show an overall process flow scheme for a commercial delayed coking process incorporating both sludge addition and oxygen addition.

In FIG. 6, lines 601 carry a residual or heavy feedstock through furnace heater 624. Lines 602 carry heated residual feed through diverter valve 603 and into lines 604 or 605, depending upon which coke drum the residual feed enters. Lines 602, 604 and 605 are generally referred to as the transfer line.

Line 631 carries an oxygen containing gaseous stream which can enter the transfer line at oxidation conditions to effect oxidation of a portion of the feedstock passing through the transfer line. Optionally, the oxygen can enter the coking drum at the upper section where vapors are present or lower in the coke drum where solid coke is present.

Coke drums 606 and 607 are vertically positioned elongated vessels into which feed can pass through inlets 627 and 628. The heated feed within the coke drum passes in an upward direction and via the coking reaction is ultimately converted to solid coke which remains within the coke drum and liquid and vapor materials. The coke drums have lower sections 608 and 609 respectively and upper sections 610 and 611 respectively. Typically, the lower sections will contain solid coke while the upper sections will generally contain vapor product which leaves the coke drums through the vapor outlets 614 and 615 respectively. In cases where sludge addition to the coke drum occurs at the top of the coke drum, sludge will be contacted with the vapors in the upper section of the coke drum.

The vaporized products along with vaporized sludge leave overhead transfer lines 616 or 617, pass through diverter valve 621 and into line 618 which passes these products into a fractionation column for further separation.

In normal operations the diverter valves 603 and 621 isolate one of the coke drums from the process while the other coke drum is being filled with coke. The isolated coke drum after being cooled during the quench cycle can then have its inlet and upper portions removed and coke can be removed from the coke drum.

Sludge can pass through line 623 into diverter valve 622 and into lines 619 or 620 depending on coke drum to which the residual feed is passing. Lines 619 and 620 carry the sludge to the coke drum head. Lines 612 and 613 which are connected to lines 620 and 619, respectively, can carry sludge into the upper section of the coke drum. Preferably, these lines are in a vertical position, and even more preferably have their outlets located at a sufficient distance down from the top of the coke drum to allow the sludge to enter the coke drum at a point where there is minimal upward vapor velocity within the upper section of coke drum. This point typically will be the widest location within the coke drum.

FIG. 7 shows a specific design for a process claimed herein.

Coke drum 701 has transfer line 706 passing into the drum through flange 705. In transfer line 706, heated residual feed can contact a gaseous stream containing oxygen which flows through line 715.

The oxygen containing gaseous stream may pass through a single entry point or through multiple injection points as shown in FIGS. 2 through 5.

Coke drum 701 contains solid coke in a lower section 712, an interface where liquids are being converted to coke in section 711, and an upper section 710 which contains vapor product leaving the interface. Residual feed passes through transfer line 706 into the coke drum where, through the coking reaction, the liquid hydrocarbon is converted to solid coke and vapor product. The vapor product eventually leaves the coke drum through vapor outlet 708 through flanges 702 and 703 and passes into line 709 which is connected to a fractionation zone.

Sludge can enter the coke drum through lines 713 and 714, although other manners of injecting sludge into the coke drum or coking process can be used.

DESCRIPTION OF THE PREFERRED EMBODIMENTS

In a broad embodiment, an invention claimed herein relates to a delayed coking process wherein a heavy hydrocarbon feed is passed through a furnace to heat the feed, the heated feed is thereafter passed through a transfer line and into a coking drum at coking conditions to effect the production of coke and lighter liquid hydrocarbon products, wherein an improvement comprises introducing into said feed passing through the transfer line at least two separate gaseous streams spaced longitudinally along the transfer line longitudinal axis and comprising oxygen at conditions including a temperature in excess of about 800° F. to effect oxidation of a portion of the feed in said transfer line.

In another embodiment, an invention claimed herein relates to a delayed coking process wherein a heavy hydrocarbon feed is passed through a furnace to heat the feed, the heated feed is thereafter passed through a transfer line comprising a conduit and into a coking drum at coking conditions to effect the production of coke and lighter liquid hydrocarbon products, wherein an improvement comprises introducing into said feed passing through the transfer line at least two separate gaseous streams spaced both longitudinally along the transfer line longitudinal axis and in a radial relationship about said axis and comprising oxygen and an inert gas, at conditions including a temperature in excess of about 800° F. to effect oxidation of a portion of the feed in said transfer line, wherein substantially all oxidation of the feed and substantially complete consumption of said oxygen occur in the transfer line.

In another embodiment, an invention claimed herein relates to a delayed coking process wherein a heavy hydrocarbon feed is passed through a furnace to heat the feed, the heated feed is thereafter passed through a transfer line comprising a conduit and into a coking drum at coking conditions to effect the production of coke and lighter liquid hydrocarbon products, wherein an improvement comprises introducing into said feed passing through the transfer line at least two separate gaseous streams spaced both longitudinally along the transfer line longitudinal axis and in a radial relationship about said axis and comprising oxygen and an inert gas, at conditions including a temperature in excess of about 800° F. to effect countercurrent contact of said gaseous stream with the feed passing through the transfer line, wherein the said contact effects oxidation of a portion of the feed in said transfer line and wherein substantially all oxidation of the feed and substantially complete consumption of said oxygen occur in the transfer line.

In another aspect of the invention, a broad embodiment relates to a coking process wherein a feed comprising residual oil is passed through a furnace to heat the feed, the heated feed is thereafter passed through a transfer line and into a coking zone at coking conditions, to effect production of solid coke and vapor products from said feed which comprises: (1) contacting the feed or liquid derived from the feed with at least one gaseous stream comprising oxygen at oxidation conditions to effect oxidation of a portion of the feed or liquid derived from the feed and, (2) adding sludge to the coking zone at thermal treatment conditions to effect contact of at least a portion of the sludge with at least a portion of the vapor products.

In another aspect of the invention, a more specific embodiment relates to a coking process wherein a heavy hydrocarbon feed comprising residual oil is passed through a furnace to heat the feed, the heated feed is thereafter passed through a transfer line and into a coking zone at coking conditions, to effect production of solid coke and vapor products from said feed which comprises: (1) introducing into the feed passing through the transfer line a gaseous stream comprising oxygen at oxidation conditions to effect oxidation of a portion of the feed in the transfer line and, (2) adding sludge to the coking zone at thermal treatment conditions to effect contact of at least a portion of the sludge with at least a portion of the vapor products.

In another aspect of the invention, a more specific embodiment relates to a delayed coking process having an elongated vertically positioned coke drum containing an upper section and a lower section, wherein a residual feed is passed through a furnace to heat the feed, the heated feed is thereafter passed through a transfer line comprising a conduit and into a lower section of the coke drum, at coking conditions to effect production of solid coke and vapor product and wherein solid coke is contained in said lower section, and vapor product is contained in the upper section, and wherein vapor product is removed from the coke drum through a vapor outlet connected to said upper section, wherein: (1) a gaseous stream comprising oxygen and an inert gas is introduced into feed passing through the transfer line at oxidation conditions to effect oxidation of a portion of the feed in the transfer line and wherein substantially all oxidation of the feed occurs in transfer line, and (2) sludge comprising liquid water, hydrocarbon, and solid materials is added to said upper section of the coke drum at thermal treatment conditions to effect contact of said sludge with vapor product in said upper section and vaporization of at least a portion of the sludge.

In another aspect of the invention, a more specific embodiment relates to a delayed coking process having an elongated vertically positioned coke drum containing an upper section and a lower section, wherein a residual feed, at least a portion of which boils in the range of from about 850° F., up to about 1250° F., is passed through a furnace to heat the feed, the heated feed is thereafter passed through a transfer line comprising a conduit and into a lower section of the coke drum at coking conditions including a feedstock temperature of from about 850° to about 970° F., a coke drum pressure of from about atmospheric to about 250 psig, and a coke drum vapor residence time of from about a few seconds up to about ten minutes to effect production of solid coke and vapor product and wherein solid coke is contained in said lower section, and vapor product, which is contained in said upper section, is removed from the coke drum through a vapor outlet connected to said upper section, wherein: (1) a gaseous stream comprising oxygen and an inert gas is introduced into feed passing through the transfer line at oxidation conditions to effect oxidation of a portion of the feed in the transfer line, and wherein substantially all of the oxidation of the feed and substantially complete consumption of the oxygen occur in the transfer line, and (2) sludge, comprising liquid water, hydrocarbons, and inorganic solids, is added to said upper section of the coke drum at thermal treatment conditions including a sludge addition rate of from about 0.01 to about 10 percent by weight based on the feed addition rate to the coking drum, to effect contact of said sludge with vapor product in the upper section and vaporization of at least a portion of the sludge.

In delayed coking operations, coke formation reactions are essentially endothermic with the temperature dropping as the formation of coke, liquid and vapor products occur within the coke drum. This temperature drop can start when the feed material leaves the feed furnace and passes through the transfer line connecting the furnace to the coke drum. A temperature drop also occurs in the delayed coking drum where most of the coking reactions occur.

During normal operations, temperature differences in the coke drum will occur. For most residual feedstocks, using normal delayed coking conditions producing anode or fuel grade coke, the vapor products leaving the coke drum through the coke drum vapor outlet are generally cooler than the vapor which is leaving the interface between the vapor and the solid coke phases within the coke drum. The temperature drop between the residual feed entering the bottom of the coke drum and the vapor material leaving the coke drum vapor outlet will be approximately about 90° to 110° F. for normal operations.

Under normal coking conditions, the hydrocarbon vapor products in upper section of the coke drum can vary in temperature from about 740° to 880° F., depending on the transfer line temperature, heat losses through the coke drum and the endothermic heat of reaction for coke production. If a steam or hydrocarbon quench is used in the top of the coke drum, the temperature of the vapors in the top of the coke drum can be reduced. In such cases, the temperature of the vapors leaving the coke drum vapor outlet can be below 780° to about 800° F. However, this can increase internal liquid recycle inside the coke drum, and if large quantities of quench hydrocarbons are used, reduced feed throughput to the coking unit can result if drum capacity or cycle time is limited.

Coking conditions include the use of heavy hydrocarbons such as residual feedstocks which pass into the coking drum through a transfer line maintained at a temperature anywhere from around 850° to about 970° F., preferably around 900° F. to 950° F. For needle coke production where decanted oils are used as feedstocks, the transfer line temperature will be higher—generally from about 950° to about 970° F. Pressures are generally regulated in the coke drum anywhere from around atmospheric to about 250 psig, but preferably from about 15 to 150 psig. Vapor residence time in the coke drum can vary anywhere from a few seconds up to ten or more minutes. Stripping steam can be added to the feed passing into the coke drum to help remove vapor materials from the produced coke at rates anywhere from about 0.2 up to about five pounds of steam per hundred pounds of total feed passing into the coke drum through the transfer line.

Delayed coking operations are cyclic in nature, having the following general cycles of operations:

(1) coke production wherein heavy feedstock is fed to a heated coke drum under conditions which cause formation of solid coke and vapor products;
(2) a quenching cycle wherein steam usually followed by water is added to the coke drum, after feedstock addition has stopped, to cool the contents of the coke drum and purge it of hydrocarbon vapors;
(3) coke removal wherein the coke drum is opened to the atmosphere and solid coke is removed from the drum;
(4) a purge and pressure test cycle wherein the coke drum is filled with steam to remove air from the drum; and
(5) drum heat up using hot vapor from another coking drum.

After the last cycle, the first cycle takes place.

The residual oil passed into the coking zone generally boils in a range of from about 850° F. up to 1250° F. or higher, with an initial atmospheric boiling point of anywhere from 850° F. to about 1150° F. and an end point around 1250° F. using the ASTM D-1160 analytical procedure at 1 millimeter mercury pressure. The coker feed is often the heaviest fraction of crude oil which is processed in the refinery and can also contain materials derived from shale oil, tar sands, coal liquids or other sources. Sometimes, the residual oil can be hydrotreated during previous processing.

In some cases, the coker feed comprises a decanted oil derived from the slurry settler associated with a fluid catalytic cracking process unit. Decanted oil will generally boil within a range of from about 450° F. to about 1150° F. using the above ASTM D-1160 test method. When the feed to the delayed coking zone is entirely decanted oil, needle coke is produced. Decanted oil or other highly aromatic oils can be used to make needle coke. The feed can also comprise a blend of decanted oil and heavier residual oil derived from the above-described sources.

Distillate oil is also called light coker gas oil and can be recycled along with the residual oil feed to the coking unit. Distillate oil recycle helps reduce coke build-up in the coker furnace and transfer line and increases the $C_5+$ liquid yields while reducing the solid coke yield. It can, however, reduce feed throughput through the coking unit, especially if the coking furnace is limiting, since the distillate oil displaces residual oil fresh feed.

Distillate oil generally has an atmospheric boiling range of from about 340° F. initial boiling point to about 750° F. end point using the standard ASTM D-86 analytical procedure. It generally is removed from the coker combination tower as a fraction residing between naphtha and the 650° F.+ gas oil material.

The boiling ranges given above for the various materials described are not meant to unduly restrict their definitions. Often these materials may have initial or end boiling points outside the stated ranges due to the vagaries which occur during distillation operations in a refinery, or in the analytical techniques used. To the extent that these materials boil within the stated boiling ranges, they are to be considered the material described.

Stripping steam or water can be added to the feed at various points in the feed furnace to assist in maintaining desired velocities through the feed furnace. Normally, stripping steam can be added to the feed passing into coke drum in quantities of from about 0.2 to about 5 percent by weight of the feed furnace charge.

Process variables of ma]or importance in delayed coking are transfer line temperature and coking drum temperature. Raising temperatures in the coke drum increases coker profitability by reducing coke yield, and for anode coking production, improves calcined coke bulk density. However, the higher temperatures required in the coke drum require increased transfer line and furnace temperatures. Increased coker furnace fouling occurs and frequent decoking of the furnace is required.

It is desirable, therefore, to increase the coke drum temperature without raising the furnace temperature. Higher coke drum temperatures can be attained by introducing air into the hot (at least 800° F.) feed passing through the transfer line which connects the coker drum and the feed furnace to oxidize some of the coker feed and raise the feed temperature. It has been shown that the temperature in the transfer line can be increased through air addition to the transfer line. A 30° F. rise in drum temperature would decrease the coke yield by 2 or more weight percent and consume a very small amount of coker feed.

Since the coke market value is often less than the value of liquid products, refiners generally have an incentive to reduce the amount of solid fuel grade coke produced and attempt to increase the liquid yield from the coker feed material.

By injecting an oxygen-containing stream into the transfer line rather than into the coke drum or into the feed furnace, the coke drum temperature can be increased with minimal problems. When injecting oxygen directly into the coking drum, especially into the lower portion of the drum where solid coke resides, localized hot spots can develop since only a small portion of the overall coke bed is being combusted. In such cases, dispersing the heat of combustion throughout the coke drum, especially into the upper portions of the coke bed where coking reactions still may take place, can be difficult. Additionally, should channeling of the oxygen occur through a crack in the coke bed, a buildup of unreacted oxygen in the coke drum could result in an explosive mixture being formed within the vessel.

Passing the oxygen along with the coker feed into the feed furnace will increase transfer line temperatures, but with a resulting increased furnace fouling rate due to the resulting increased furnace tube skin temperatures.

Coking operations generally use a furnace with heating tubes through which the feed oil to be coked is passed and heated to a temperature above 800° F. to from about 870° to 970° F., and preferably from 890° to 950° F. at pressures from atmospheric to about 250 psig, preferably from about 15 to about 150 psig. On reaching the desired preheat temperature the heated feed is discharged through a transfer line which connects the furnace to the delayed coking drum. The transfer line generally is connected to the bottom of the coking drum allowing flow of material from the transfer line into the coking drum and upwardly through the drum.

The coking drum has an overhead line from which vaporous products from the coking reaction and the reaction products which result from oxidation of the feed in the transfer line with the oxygen containing stream can be withdrawn and passed to a fractionator referred to in the art as a combination tower. The residual feed to the coking drum undergoes cracking reactions within the coking drum and becomes reduced to a solid coke material and vapors. The latter are removed from the overhead portion of the coking drum, condensed, fractionated and processed under the particular refinery's requirements.

The solid coke accumulates in the coking drum and at a predetermined time coker feed is diverted into another coking drum through a manifold system. The filled coking drum is stripped of any remaining liquid and vaporous hydrocarbon products and the coke within the drum is cooled, generally by water quench. The solid coke is then removed from the coking drum through use of water jets, drills, rams or other equipment for dislodging and sometimes grinding the coke to a suitable product quality.

The transfer line described and claimed herein refers to any means which connects the outlet of the feed from the furnace heater to the coker drum. Typically, the transfer line is a large insulated line which directly connects the outlet of the feed furnace to the lower portion of the coking drum which is being operated for production of coke. The transfer line also can include any manifold piping necessary including related valves or switching means which allow the heated coker feed to be switched between one or more coke drums depending on the particular drum being fed. Typically, in a normal delayed coking operation two or more coking drums are hooked in a parallel piping configuration with a transfer line being connected to a manifold which allows the heated feed passing through the transfer line to eventually be passed into a predetermined coking drum.

Since the feed passing through the transfer line is at a temperature above 800° F. where oxidation can occur very rapidly, the oxygen-containing gas passed into the transfer line is preferably conducted through multiple injection points. The oxygen-containing gas can comprise pure or purified oxygen, or combinations of oxygen and inert, combustible gas or steam. The gas can also comprise air or oxygen in combination with nitrogen in a combustible light gas such as methane or natural gas. Depending on the control system which is used to monitor the flow of oxygen passing into the transfer line, an inert gas such as nitrogen, or steam or a unreactive material such as a relatively inert hydrocarbon may be blended with oxygen or air to allow for effective and safer control of the combustion taking place in the transfer line.

The use of a combustible light gas mixed with the oxygen-containing gas can allow ignition of the mixture prior to its contact with the feed. This can help induce a high localized temperature which can assure rapid, but controlled, oxidation of feed in the transfer line with little chance for free oxygen to enter the downstream coking apparatus. It is important to minimize or eliminate the accumulation of oxygen gas in downstream equipment due to the potential for explosive atmospheres which may be created.

Depending on the amount of combustion which takes place within the transfer line and the size of the downstream gas-processing equipment within a refinery, the oxygen-containing gas passing into the transfer line may vary from purified oxygen to a low purity oxygen-containing gas. In instances in which a relatively pure oxygen-containing gas is used as a combustion gas, a smaller load will be put on downstream gas-handling equipment such as compressors since there is less inert gas to handle.

When adding the oxygen-containing gas to the transfer line it preferably should be done through multiple injection nozzles to allow good contact of the oxygen with the feed. This can be done through use of spargers or other mechanisms which will allow the oxygen-containing gas passed into the transfer line to be intimately contacted with the heated feedstock passing through the transfer line. This helps promote oxidation or combustion of a portion of the feed and substantially complete consumption of the oxygen contained in the oxygen-containing gas.

In a delayed coking operation, it is preferable that substantially complete consumption of the oxygen take place in the transfer line or in the lower section of the coke drum to prevent a buildup of oxygen gas in the upper portions of the coking drum or in the gas-processing equipment where it may form an explosive mixture. However, depending on the composition of the gases within the coking drum and in the downstream gas-processing equipment, uncombusted oxygen may pass through the transfer line and into the coking drum and into the refiner's gas-processing equipment. In such cases it will be necessary to closely monitor the oxygen concentration within the coking drum and other gas-processing equipment to prevent high oxygen concentrations which could result in an explosive mixture at the conditions residing in the equipment where this concentration is present. In a most preferred instance, the oxygen passed into the transfer line will be completely consumed within the transfer line so that no free oxygen will pass out of the transfer line and into the coking drum and associated downstream gas-processing equipment. In order to achieve oxidation in the transfer line, its temperature should be reasonably high. Preferably, it should be above 800° F. up to 1000° F. or higher. More preferably, the transfer line should be from about 850° F. to about 950° F.

The oxygen in the upper portions of the coke drum and combination tower should be closely monitored. In some cases, the carbon dioxide level may be monitored. By monitoring these component levels, combustion in the upper portions of the coke drum and combination can be prevented. If the level of oxygen is allowed to reach high enough concentration to support combustion, an explosion could result.

It is preferable to maintain the oxygen level well below the explosion envelope at the prevailing conditions in the coke drum and combination tower. Usually the oxygen level will be kept below 10 volume percent and most often well below 4 volume percent concentration in the vapor being monitored.

Through well known control systems, the amount of oxygen entering the transfer line can be regulated based on the monitored oxygen levels in the coke drum vapor spaces. Also, temperature monitoring of the transfer line or the above vapor spaces or both can be used to supplementally control oxygen addition to the transfer line.

In the event of a high temperature excursion at any of the temperature monitoring locations or measurement of high concentrations of oxygen, corrective measures can be taken including shutting off oxygen flow to that transfer line. Inert gas flow to the transfer line or directly to the vessel having high oxygen concentrations may be initiated.

The oxygen flow control system should preferably be designed to be fail safe closed so that when power or control signal is lost, oxygen flow to the transfer line is stopped.

The amount of oxygen-containing gas passed into the transfer line will depend on many factors including the concentration of oxygen within the oxygen-containing gas, the amount of temperature increase in the transfer line required by the refiner and the degree of mixing of the gas in that transfer line. The temperatures of the feedstock passing through the transfer line can be increased anywhere from a few degrees Fahrenheit to 100 or more degrees Fahrenheit depending on the amount of combustion of the feed passing through the transfer line that the refiner can tolerate and the ability to safely combust feed in the transfer line.

From 0.01 up to 1 weight percent or more of the feed passing into the transfer line can be combusted through contact with the oxygen-containing gas passing into the transfer line through the multiple injection points. The resulting increase in transfer line temperature, and to a small extent the resulting decrease in feed passing into the coking drum because a portion of it has been combusted, will reduce the coke yield anywhere from a few tenths up to two or more weight percent while the liquids produced from the coker are also increased.

Sludge typically comprises organic and inorganic waste materials mixed with water and generally in the form of a mixture of one or more liquids often with solids. Individual sludges, as shown in Table I below, can vary greatly in the concentrations of water, solids and liquid organic materials (such as hydrocarbon oil) depending on the source of the sludge. They can be in the form of suspensions, emulsions, or slurries and generally contain large amounts of water. In some cases the sludge can comprise only liquid materials and in other cases the sludge can comprise a thick slurry of heavy liquids and solid material.

When the individual sludges are combined for addition to the coking zone, the composition of the combined sludge can comprise anywhere from less than one up to about 15 weight percent or more solids, from less than one up to about 15 weight percent or more hydrocarbon oils, and anywhere from a few up to 98 weight percent or more water.

In some cases the sludge can comprise water and hydrocarbon oil with very little, if any, solids. The individual sludges may comprise anywhere from less than one up to 80 or more weight percent solids, from less than one up to 80 or more weight percent of hydrocarbon oils, and anywhere from a few up to 98 weight percent or more water.

The oil or organic material may be solid, semi-solid or a liquid material and is preferably a hydrocarbonaceous material. The solid may comprise organic or inorganic material and, in some cases, can comprise both. Preferably, the aqueous sludge is an industrial sludge derived from wastewater treatment plants of petroleum refineries or petrochemical plants comprising hydrocarbonaceous materials.

Table I below shows sludge production and solids and hydrocarbon oils contents (the remaining material being water) for aqueous wastewater sludges found in a typical refinery producing a broad range of refinery products:

TABLE I

| Aqueous Wastewater Sludge Description | Solids Wt % | Oil Wt % | Pounds Per Day | |
|---|---|---|---|---|
| API Separator Bottoms | 3.9 | 2.5 | 6,600 | |
| Slop Oil Emulsions | — | 84.0 | 3,280 | |
| Leaded Tank Bottoms | 6.1 | — | 30 | |
| Unleaded Tank Bottoms | 66.0 | 12.0 | 3,030 | |
| Heat Exchange Sludge | 17.0 | — | 6 | |
| Oily Waste | — | 7.7 | 55 | |
| MEA Reclaimer Sludge | 6.2 | 0.2 | 99 | |
| ASP Sludge from Digester | 2.0 | 0.34 | 22,600 | |
| Average | 7.6 | 9.4 | 35,700 | Total |

When both sludge and a gaseous stream comprising oxygen are added to the coking zone, the sludge is added to the coking zone to effect contact of at least a portion of the sludge with at least a portion of the feed, or liquid derived from the feed or vapor products or combinations of these three components. When the sludge contacts the feed, it can be injected into the transfer line or into the part of the coking zone where feed first enters the coke drum or the fluidized coking reactor. The liquid derived from the feed can be partially converted feed which can further react vapors and coke.

Preferably, sludge contacts the vapors formed in the coking zone although the combination of sludge addition with addition of a gaseous oxygen stream to the coking zone can be practiced with sludge addition to the coking zone feed or to locations in the coking zone where partially converted feed is present.

The sludge is added to the coking zone at thermal treatment conditions which include a temperature high enough to convert the sludge to vapors and, if cokable materials are present, to coke.

Thermal treatment conditions also include temperatures in the upper section of the coke drum varying from about 740 ° F. up to about 850 ° F. Temperatures can vary depending on the type of feedstock being fed to the coker, the type of coke being produced, wastewater sludge addition rate to the coke drum, and the composition of the wastewater sludge. Particular attention should be paid to maintaining a sufficiently high temperature in the coking zone to allow toxic substances contained in the sludge to be decomposed into materials which are deemed safe in the refining industry or which can be more easily handled.

If the sludge is dewatered, thermal treatment conditions can include vaporization of any vaporizable hydrocarbons and if cokable materials (liquids or solids) are present, they can be thermally decomposed into coke as a product or coproduct. In some cases, the cokable materials can be first broken down into vaporous and some or all of the remaining heavy materials can be thermally converted to coke.

In some cases where the sludge contains no cokable materials, thermal treatment conditions include vaporization of the sludge, or thermal decomposition of the sludge into vaporous materials.

Thermal treatment conditions also include a preferred sludge addition rate of from about 0.1 to about 5 percent by weight, and even more preferably, from about 0.1 to 1 percent by weight, based on the feedstock addition rate to the coking drum. It is most preferable to maintain the sludge addition rate below 1 weight percent of the feedstock addition rate to the coke drum.

When sludge is injected into the upper section of a coke drum, thermal treatment conditions can include at a rate of from about 0.1 to about 10 percent by weight, based on the feedstock addition rate to the coking drum; sufficient temperature in the upper section of the coke drum to vaporize substantially any of the water and vaporizable hydrocarbons which may be present in the sludge while thermally decomposing some of the heavy hydrocarbons in the sludge to coke; migration of the above coke to the coke bed contained within the coke drum; and, preferably injection of the sludge into the upper section of the coke drum at a point where the upward velocity of vapor in the drum will not entrain liquid or solids from the sludge.

In a more preferred instance, thermal treatment conditions include injection of the sludge into the upper section of the coke drum at a location where there is minimum upward vapor velocity of vapors within the upper section of the coke drum. This is preferred to prevent carry over of solids or heavy hydrocarbons contained in the sludge before decomposition can take place. This material can cause fouling of coke drum vapor outlet lines and associated downstream processing equipment.

Placement of the sludge injection point within the upper section of the coke drum can in some instances be critical. The vapor velocity increases rapidly in the coke drum head reading as high as 80 feet per second at the vapor outlet. In the head it is high enough to carry solids or liquid droplets from the upper section of the coke drum into the vapor outlet.

Accordingly, the sludge injection point should be located within the upper section where reduced or minimum upward velocities occur. When locating the sludge injection point consideration should also be given to the coking effects which may occur on surrounding internal equipment or surfaces in the coke drum. If the injection point is located too close to the coker wall, a cold spot may develop.

In terms of vapor velocities within the coke drum, the sludge injection point should be located where the upward superficial velocity of vapors during the coking cycle are less than 10 feet per second, more preferably where the upward superficial velocity is less than one foot per second, and even more preferably where the upward superficial velocity is about 0.3 to 0.6 feet per second or less.

The upper and lower sections of a coking zone refer to the interior volume within a delayed coking zone which contains vapor products and the solid coke bed respectively. The upper section also will contain sludge since it is injected into this part of the coke drum.

During the normal operation of a delayed coker, the solid coke bed height within the coke drum gradually increases as more coke is produced. Accordingly, the volume encompassed by the lower section of the coke drum, which contains the solid coke bed will also change to accommodate the increasing volume of solid coke produced in the coke drum.

The interface between the solid coke bed and the vapor phase within the coke drum will normally be comprised of liquid foam and can be located within the upper or lower section of the coke drum.

The sludge is injected into the upper section within the coke drum. In order to prevent operation problems from occurring during sludge injection into the upper section, there must be sufficient vapor space provided in the upper section to allow vaporizable materials in the sludge to vaporize and the other materials to be converted to coke or returned to the coke bed as solids.

In the case of a fluid coking operation, the sludge can be passed into the upper section of a fluidized coking reaction vessel where small quantities of fluidized coke particles exist or the sludge can be passed directly into the dense bed of fluidized coke particles near the bottom of the vessel. The sludge can also be combined with the feed to the fluid coking reactor.

In delayed coking, since it is important to maintain relatively high temperatures in the upper section of the coke drum during sludge addition, the addition of sludge preferably should take place during the coke producing cycle of operations (when feedstock is being added to the coking drum).

It is especially preferable to add sludge to the coke drum only during the coke production cycle in order to take advantage of the higher temperatures which exist during this cycle. Adding sludge during the quenching cycle may prove deleterious, since cooling occurs within the coke drum and any toxic substances in the sludge may not be converted to harmless coke and liquid and gaseous products at the lower temperatures.

To prevent the sludge from causing excess conversion, inhibitors can be added as well as antifoaming agents.

In cases where too much water is present in the sludge coker recycle liquids may be mixed with the sludge to help preheat the sludge before it enters the coking zone.

In some case, an oxygen containing gas can be added to the sludge prior to its injection into the coking zone. This can help oxidation of sludge which will increase its temperature thereby assisting its conversion to less toxic or more valuable products.

EXAMPLE I

In this Example three computer runs were made using a proprietary delayed coking model to show the benefits associated with the use of increased transfer line temperatures resulting from the combustion in the transfer line of resid feed passing into the delayed coking drum.

The Base Case represented the yields for a delayed coking process in which the transfer line temperature is maintained at 870° F. and no oxygen was added to the transfer line. Case A represented an operation in which the transfer line temperature was increased above the Base Case by 30° F. by the addition of oxygen through multiple injection points in the transfer line going into the delayed coking drum. Case B illustrates the yields associated with a 60° F. increase in transfer line temperature over the Base Case where additional oxygen is added to the transfer line to allow a larger increase in temperature.

In all three runs the feedstock had an atomic hydrogen-to-carbon ratio of 1.448, a sulfur content of 3.4 wt. %, a nitrogen content of 0.60 wt. %, vanadium in the concentration of 165 ppm, a rams carbon value of 17.8 wt. %, an API of 6.6° and a nickel concentration of 55 ppm.

For all three runs the same operating conditions were maintained except for the transfer line temperature and addition of the oxygen-containing gas. The delayed coker modeled was a commercial-coking unit located in an operating refinery. The delayed coking feed rate was set at approximately 25,500 barrels per stream day. The pressure at the outlet of the coking drum was maintained at 35 psig, and steam addition to the coking drum and transfer line was maintained at 2,400 pounds per hour. The unit was operated with a 12-hour cycle time (the time for a complete cycle of the delayed coking drums operations from initially adding residual feed to an empty drum through removing the solid coke from the drum).

In the Base Case, a normal delayed coking operation was simulated, and the yields and properties of the various components produced are reported in Table II. Cases A and B which show the invention herein were simulations with transfer line temperatures of 900° F. and 930° F., respectively. These cases report both pure oxygen and alternatively, the air feed rates necessary to achieve the desired increase in transfer line temperature. There is little difference in the reported results when pure oxygen, or alternatively, when air is used as the combustion gas. All three cases are reported in Table II below.

TABLE II

| | Base Case | Case A | Case B |
|---|---|---|---|
| Transfer Line Temp., °F. | 870 | 900 | 930 |
| Feed Oxidized, Barrels/Day | — | 60.5 | 99 |
| Feed Oxidized, Wt. % of Feed | — | 0.23 | 0.39 |
| Oxygen Feed Rate, SCFH | — | 20,295 | 33,210 |
| Air Feed Rate, SCFH | — | 96,643 | 158,143 |
| Product Yields | | | |
| $C_4$— Gas*, Wt. % | 9.21 | 10.31 | 11.49 |
| $C_5$ to 200° F. | | | |
| Wt. % | 1.65 | 1.77 | 1.99 |
| Volume % | 2.44 | 2.66 | 2.97 |
| API, Degrees | 73.4 | 72.6 | 71.9 |
| Sulfur, Wt. % | 0.23 | 0.25 | 0.26 |
| Nitrogen, PPM | 44 | 52 | 59 |
| 200 to 360° F. | | | |
| Wt. % | 5.12 | 5.69 | 6.25 |
| Volume % | 6.85 | 7.62 | 8.39 |
| API, Degrees | 53.1 | 53.1 | 53.1 |
| Sulfur, Wt. % | 0.47 | 0.50 | 0.52 |
| Nitrogen, PPM | 115 | 144 | 173 |
| 360 to 650° F. | | | |
| Wt. % | 31.50 | 29.45 | 27.30 |
| Volume % | 37.50 | 35.06 | 32.52 |
| API, Degrees | 32.9 | 32.9 | 32.9 |
| Sulfur, Wt. % | 1.37 | 1.45 | 1.52 |
| Nitrogen, Wt. % | 0.10 | 0.10 | 0.10 |
| 650°+ F. | | | |
| Wt. % | 18.06 | 19.69 | 21.33 |
| Volume % | 19.58 | 21.18 | 22.77 |
| API, Degrees | 18.2 | 17.1 | 15.9 |
| Sulfur, Wt. % | 1.89 | 2.11 | 2.33 |
| Nitrogen, Wt. % | 0.31 | 0.36 | 0.40 |
| Coke | | | |
| Wt. % | 34.46 | 32.86 | 31.25 |
| Sulfur, Wt. % | 4.77 | 4.77 | 4.77 |
| Nitrogen, Wt. % | 1.49 | 1.52 | 1.55 |
| Volatiles (ASTM D-3175), Wt. % | 19.90 | 16.12 | 12.34 |
| Nickel, PPM | 160 | 167 | 176 |
| Vanadium, PPM | 479 | 502 | 528 |
| Other Metals, PPM | 119 | 125 | 131 |

*Excludes products of combustion with oxygen.

As can be seen from the data reported in Table II above, the increased transfer line temperatures resulted in certain process advantages to the refiner. The coke yield resulting from the higher transfer line temperatures was reduced from approximately 34.46 wt. % for the Base Case to 31.25 wt. % for Case B. In all Cases the total liquids produced—that is $C_5+$ liquids, increased with the increased transfer line temperatures. An additional benefit achieved from practicing the process of this invention is that the density of the coke produced in Cases A and B was increased.

EXAMPLE II

In this Example data was generated for a study to determine the feasibility of adding oxygen to a delayed coking unit which also operated with sludge addition to the coke drum.

The coke drum had an approximate inside diameter of 18 feet. Sludge was injected only during the coking cycle and through a vertical tube which passed through the coke drum head.

During sludge addition, the residual feed rate to the coke drum was set at approximately 7000 barrels per day of vacuum resid derived from a mixture of Jobo and Trinidad based crudes. Coke production was targeted to produce a fuel grade coke. A sludge having the average composition shown in Table I was injected into the top portion of the coke drum at a rate of approximately 2 gallons per minute.

The sludge injection reduced the overhead vapors leaving the drum about 30° F. (from about 825° F. to about 795° F.).

In order to make up for this reduction in overhead vapor temperature, approximately 600 standard cubic feet per minute of air was injected into the feed transfer line at conditions to effect oxidation of a portion of the feed passing through the transfer line.

We claim as our invention:

1. In a delayed coking process wherein a heavy hydrocarbon feed is passed through a furnace to heat the feed, the heated feed is thereafter passed through a transfer line comprising a conduit and into a coking drum at coking conditions to effect the production of coke and lighter liquid hydrocarbon products, wherein an improvement comprises introducing into said feed which is passing through the transfer line at a temperature in the range of from about 870° F. to about 950° F. at least one gaseous stream comprising oxygen, at conditions to effect combustion of a portion of the feed in said transfer line to form products of combustion comprising carbon monoxide and carbon dioxide and wherein substantially all combustion of the feed and substantially complete consumption of said oxygen occur in the transfer line.

2. The process of claim 1 further characterized in that said gaseous stream comprises oxygen in combination with inert gas.

3. The process of claim 2 further characterized in that said gaseous streams comprise oxygen, inert gas and a combustible gas.

4. The process of claim 1 further characterized in that said gaseous streams comprise oxygen, inert gas, and a combustible gas.

5. In a delayed coking process wherein a heavy hydrocarbon feed is passed through a furnace to heat the feed, the heated feed is thereafter passed through a transfer line comprising a conduit and into a coking drum at coking conditions to effect the production of coke and lighter liquid hydrocarbon products, wherein an improvement comprises introducing into the feed which is passing through the transfer line at a temperature in excess of 850° F. at least one gaseous stream comprising oxygen at conditions to effect combustion of a portion of the feed in said transfer line to form products of combustion comprising carbon monoxide and carbon dioxide, wherein substantially all combustion of the feed and substantially complete consumption of said oxygen occur in the transfer line.

6. The process of claim 5 further characterized in that said gaseous stream comprises oxygen, inert gas, and a combustible gas.

7. The process of claim 5 further characterized in that said gaseous stream is introduced into the heavy hydrocarbon passing through the transfer line at conditions to effect countercurrent contact of said gaseous stream with the feed passing through the transfer line.

8. A coking process wherein a heavy hydrocarbon feed comprising residual oil is passed into a coking zone at coking conditions including a feed temperature in excess of 850° F., to effect production of solid coke and vapor products from the feed which comprises: (1) contacting the feed or liquid derived from the feed with at least one gaseous stream comprising oxygen at conditions to effect combustion of a portion of the feed or liquid derived from the feed to form products of combustion comprising carbon monoxide and carbon dioxide and, (2) adding sludge to the coking zone at thermal treatment conditions to effect contact of at least a portion of the sludge with at least a portion of said feed, liquid derived from the feed or vapor products.

9. The process of claim 8 further characterized in that said gaseous stream effects combustion of a portion of the feed.

10. The process of claim 9 further characterized in that said gaseous stream effects combustion of a portion of the liquid derived from the feed.

11. The process of claim 10 further characterized in that the liquid derived from feed includes at least partially thermally converted feed.

12. The process of claim 9 further characterized in that the feed is passed through a furnace to be heated, thereafter passed through a transfer line and into the coking zone.

13. The process of claim 12 further characterized in that said gaseous stream contacts the feed passing through the transfer line to effect combustion of a portion of the feed in the transfer line.

14. The process of claim 8 further characterized in that said coking zone comprises a delayed coker.

15. The process of claim 8 further characterized in that said,, sludge comprises water and organic material.

16. The process of claim 8 further characterized in that said coking zone comprises a delayed coking drum having an upper section containing vapor products and a lower section containing solid coke, wherein said feed passes into said lower section of the coking drum, vapor products are removed from the coking drum from said upper section and sludge passes into the upper section of the coking drum.

17. The process of claim 8 further characterized in that the sludge is added to the coking zone as a stream separate from the feed and contacts the vapor products in the coking zone.

18. The process of claim 9 further characterized in that said coking zone comprises a delayed coking drum having an upper section containing vapor products and a lower section containing solid coke, wherein said feed passes into said lower section of the coking drum, vapor products are removed from the coking drum from said upper section and sludge passes into the upper section of the coking drum.

19. The process of claim 9 further characterized in that the sludge is added to the coking zone as a stream separate from the feed and contacts the vapor products in the coking zone.

20. The process of claim 8 further characterized in that at least a portion of said feed boils in the range of from about 850° up to about 1250° F. or higher; said coking conditions include a feed temperature of from about 870° to about 950° F., a coking zone pressure of from about atmospheric to about 250 psig, and a coking zone vapor residence time of from about a few seconds up to ten or more minutes; and a sludge addition rate of from about 0.01 to about 10 percent by weight, based on the feed addition rate to the coking zone.

21. A coking process wherein a heavy hydrocarbon feed comprising residual oil is passed through a furnace to heat the feed, the heated feed is thereafter passed through a transfer line at a feed temperature above 850° F. and into a coking zone at coking conditions, to effect production of solid coke and vapor products from said feed which comprises: (1) introducing into the feed passing through the transfer line a gaseous stream comprising oxygen at combustion conditions to effect combustion of a portion of the feed in the transfer line to form products of combustion comprising carbon monoxide and carbon dioxide and, (2) adding sludge to the coking zone at thermal treatment conditions to effect contact of at least a portion of the sludge with at least a portion of the vapor products.

22. the process of claim 21 further characterized in that said coking zone comprises a delayed coker.

23. The process of claim 21 further characterized in that said sludge comprises water and organic material.

24. The process of claim 21 further characterized in that said sludge comprises liquid water and liquid hydrocarbon oil.

25. The process of claim 21 further characterized in that said sludge comprises water, hydrocarbon oil and solid material.

26. The process of claim 21 further characterized in that said coking zone comprises a delayed coking drum having an upper section containing vapor products and a lower section containing solid coke, wherein said feed passes into said lower section of the coking drum, vapor products are removed from the coking drum from said upper section and sludge passes into the upper section of the coking drum.

27. The process of claim 21 further characterized in that the sludge is added to the coking zone as a stream separate from the feed and contacts the vapor products in the coking zone.

28. The process of claim 21 further characterized in that at least a portion of said feed boils in the range of from about 850° up to about 1250° F. or higher; said coking conditions include a feed temperature of from above 850° up to about 970° F., a coking zone pressure of from about atmospheric to about 250 psig, and a coking zone vapor residence time of from about a few seconds up to ten or more minutes; and a sludge addition rate of from about 0.01 to about 10 percent by weight, based on the feed addition rate to the coking zone.

29. A delayed coking process having an elongated vertically positioned coke drum containing an upper section and a lower section, wherein a residual feed is passed through a furnace to be heated, the heated feed at a temperature above 850° F. is thereafter passed through a transfer line comprising a conduit and into a lower section of the coke drum, at coking conditions to effect production of solid coke and wherein solid coke is contained in the lower section and vapor product is contained in the upper section, and wherein vapor product is removed from the coke drum through a vapor outlet connected to said upper section, wherein: (1) a gaseous stream comprising oxygen is introduced into feed passing through the transfer line at conditions to effect combustion of a portion of the feed in the transfer line to form products of combustion comprising carbon monoxide and carbon dioxide and wherein substantially all combustion of the feed occurs in transfer line, and (2) sludge comprising liquid water, hydrocarbons, and solid materials is added to the upper section of the coke drum at thermal treatment conditions to effect contact of said sludge with vapor product in said upper section and vaporization of at least a portion of the sludge.

30. The process of claim 29 further characterized in the substantially complete consumption of said oxygen occurs in the transfer line.

31. The process of claim 29 further characterized in that said feed comprises heavy residual hydrocarbons, at least a portion of which, boils in the range of from about 850° up to about 1250° F. or higher; said coking conditions include a feed temperature of from above 850° F. up to about 970° F., a coking zone pressure of from about atmospheric to about 250 psig, and a coking zone vapor residence time of from about a few second up to ten or more minutes; and a sludge addition rate of from about 0.01 to about 10 percent by weight, based on the feed addition rage to the coking zone.

32. A delayed coking process having an elongated vertically positioned coke drum containing an upper section and a lower section, wherein a residual feed, at least a portion of which boils in the range of from about 850° F. up to about 1250° F., is passed through a furnace to be heated, the heated feed is thereafter passed through a transfer line comprising a conduit and into a lower section of the coke drum at coking conditions including a feed temperature of from about 870° F. up to about 950° F., a coke drum pressure of from about atmospheric to about 250 psig, and a coke drum vapor residence time of from about a few seconds up to about ten minutes to effect production of solid coke and vapor product and wherein solid coke is contained in said lower section, and vapor product, which is contained in said upper section, is removed from the coke drum through a vapor outlet connection to said upper section, wherein: (1) a gaseous stream comprising oxygen is introduced into feed passing through the transfer line at conditions to effect combustion of a portion of the feedstock in the transfer line to form products of combustion comprising a carbon monoxide and carbon dioxide, and wherein substantially all of the combustion of the feed occurs in the transfer line, and substantially complete consumption of the oxygen occurs in the transfer line, and (2) sludge, comprising liquid water, hydrocarbons, and inorganic solids is added to said upper section of the coke drum at thermal treatment conditions including a sludge addition rate of from about 0.01 to about 10 percent by weight based on the feed addition rate to the coking drum to effect contact of said sludge with vapor product in the upper section and vaporization of at least a portion of the sludge.

33. The process of claim 32 further characterized in that said sludge is added at a rate of from about 0.01 to about 1.5 percent by weight, based on the feed addition rate to the coking drum.

34. The process of claim 32 further characterized in that said sludge comprises from about 1 to about 20 percent, by weight, of inorganic solids, from about 1 to about 20 percent, by weight, of liquid hydrocarbons and from about 98 down to about 60 percent, by weight, of liquid water.

35. The process of claim 5 further characterized in that the feed temperature is in the range of from about 850° F. to about 970° F.

36. The process of claim 5 further characterized in that the feed temperature is in the range of from about 870° F. to about 950° F.

* * * * *

UNITED STATES PATENT AND TRADEMARK OFFICE

CERTIFICATE OF CORRECTION

PATENT NO. : 5,041,207

DATED : August 20, 1991

INVENTOR(S) : Harrington, et al

It is certified that error appears in the above-identified patent and that said Letters Patent is hereby corrected as shown below:

| Col. | Line | |
|---|---|---|
| 1 | 13 | "herewith." should be --herewith having a docket number 26,878.-- |
| 9 | 30 | "oxygen containing gas" should be --oxygen-containing gas-- |
| 9 | 44 | "oxygen containing gas" should be --oxygen-containing gas-- |
| 9 | 59 | "points along ,transfer line" should be --points along transfer line-- |
| 10 | 16 | "oxygen containing gaseous" should be --oxygen-containing gaseous-- |
| 11 | 1 | "oxygen containing" should be --oxygen-containing-- |
| 15 | 7 | "Process variables of major" should be --Process variables of major-- |
| 16 | 47 | "steam or a unreactive" should be --steam or an unreactive-- |
| 24 | 48 | "said,, sludge" should be --said sludge-- |
| 26 | 2 | "of solid coke and wherein" should be --of solid coke and vapor products and wherein-- |
| 26 | 31 | "feed addition rage" should be --feed addition rate-- |

Signed and Sealed this

Twentieth Day of April, 1993

*Attest:*

MICHAEL K. KIRK

*Attesting Officer*

*Acting Commissioner of Patents and Trademarks*